US008297066B2

(12) United States Patent
Bora

(10) Patent No.: US 8,297,066 B2
(45) Date of Patent: Oct. 30, 2012

(54) REFRIGERATION UNIT AND RESPECTIVE CONTROL AND MANAGEMENT ASSEMBLY

(75) Inventor: Luca Bora, Civitanova Marche (IT)

(73) Assignee: Indel B S.p.A., Sant'Agata Feltria (IT)

( * ) Notice: Subject to any disclaimer, the term of this patent is extended or adjusted under 35 U.S.C. 154(b) by 703 days.

(21) Appl. No.: 12/453,224

(22) Filed: May 4, 2009

(65) Prior Publication Data

US 2009/0277200 A1 Nov. 12, 2009

(30) Foreign Application Priority Data

May 6, 2008 (EP) ..... 08425310

(51) Int. Cl.
*G05D 23/32* (2006.01)
*A01K 1/00* (2006.01)
*F24F 11/00* (2006.01)

(52) U.S. Cl. ..... 62/158; 236/46 A; 165/237

(58) Field of Classification Search ..... 62/129, 62/158; 236/51, 64 A; 165/237
See application file for complete search history.

(56) References Cited

FOREIGN PATENT DOCUMENTS

| | | | | |
|---|---|---|---|---|
| CN | 2750263 | Y | | 1/2006 |
| EP | 0 881 443 | A | | 12/1998 |
| JP | 03225170 | A | * | 10/1991 |
| JP | 11173727 | A | * | 7/1999 |
| WO | WO 2007/032608 | A | | 3/2007 |
| WO | WO 2007032608 | A1 | * | 3/2007 |

* cited by examiner

*Primary Examiner* — Chen Wen Jiang
(74) *Attorney, Agent, or Firm* — Modiano & Partners; Albert Josif; Daniel J. O'Byrne

(57) ABSTRACT

A refrigeration unit and a respective control and management assembly, comprising a refrigeration assembly and at least one power input for its electrical power supply. The refrigeration unit comprising at least one signal input and at least one control switch, which is arranged along a power line which corresponds to the power input. The control switch controlling the power line and the data that arrive from the respective signal input being suitable for driving the control switch for consequently determining the presence/absence of electrical power supply for said refrigeration assembly.

13 Claims, 3 Drawing Sheets

REFRIGERATION UNIT AND RESPECTIVE CONTROL AND MANAGEMENT ASSEMBLY

The present invention relates to a refrigeration unit and to the respective control and management assembly.

BACKGROUND OF THE INVENTION

Currently, it is now common practice to provide rooms of hotels, substantially of any category, with small refrigerators, generally known as minibars, in which beverages and/or liqueurs, and optionally foodstuffs such as confectionery or the like, are stored and are thus made available to the occupants of the room.

According to a known constructive solution, the desired temperature of the compartment inside the minibar in which the beverages and foodstuffs are to be accommodated is achieved by using a compressor; this compressor is activated for example by a thermostat when a given temperature limit is exceeded and is deactivated when the desired temperature is restored.

However, noise is associated with the operation of the compressor and is generated by the compressor itself and can annoy the people who are present in the room, particularly during night hours, if the thermostat detects an increase in the internal temperature of the compartment, with consequent activation of the compressor.

The drawback described above is partially remedied by constructive solutions which resort to devices such as timers or the like, by means of which cycles for switching on and off at preset times are predefined.

In this manner, for example, it is possible to provide for activation of the compressor only during daytime, to ensure absence of noise during the night, optionally inserting in the minibar a heat accumulator, which is also cooled by the compressor and is capable of removing heat once the compressor is deactivated in order to further defer the moment when such compressor switches on again.

It is evident that this solution cannot be deemed satisfactory, since it is not possible to establish beforehand at what times during the day the room is actually free of its occupants, who might instead dwell in the room during the very hours programmed for compressor power-on and operation.

SUMMARY OF THE INVENTION

The aim of the present invention is to solve the drawbacks described above by providing a refrigeration unit and respective control and management assembly in which the noise associated with operation does not annoy the people who are present in the immediate vicinity.

Within this aim, an object of the invention is to provide a refrigeration unit, such as minibars for hotels and the like, which can ensure the preservation at a predefined temperature of foodstuffs and beverages in a room without annoying the occupants of the room.

Another object of the invention is to provide a refrigeration unit which ensures high reliability in operation.

Another object of the invention is to provide a refrigeration unit which can be obtained easily starting from commonly commercially available elements and materials.

Another object of the invention is to provide a refrigeration unit which has low costs and is safe in application.

This aim and these and other objects, which will become better apparent hereinafter, are achieved by a refrigeration unit and a respective control and management assembly, which comprises a refrigeration assembly and at least one power input for its electrical power supply, characterized in that said refrigeration unit comprises at least one signal input and at least one control switch, arranged along a power line which corresponds to said power input and controls it, the data that arrive from the respective said signal input being suitable for driving said control switch for consequently determining the presence/absence of electrical power supply for said refrigeration assembly.

BRIEF DESCRIPTION OF THE DRAWINGS

Further characteristics and advantages of the invention will become better apparent from the following detailed description of a preferred but not exclusive embodiment of the refrigeration unit according to the invention, illustrated by way of non-limiting example in the accompanying drawings, wherein.

DESCRIPTION OF THE PREFERRED EMBODIMENTS

Figure 1:
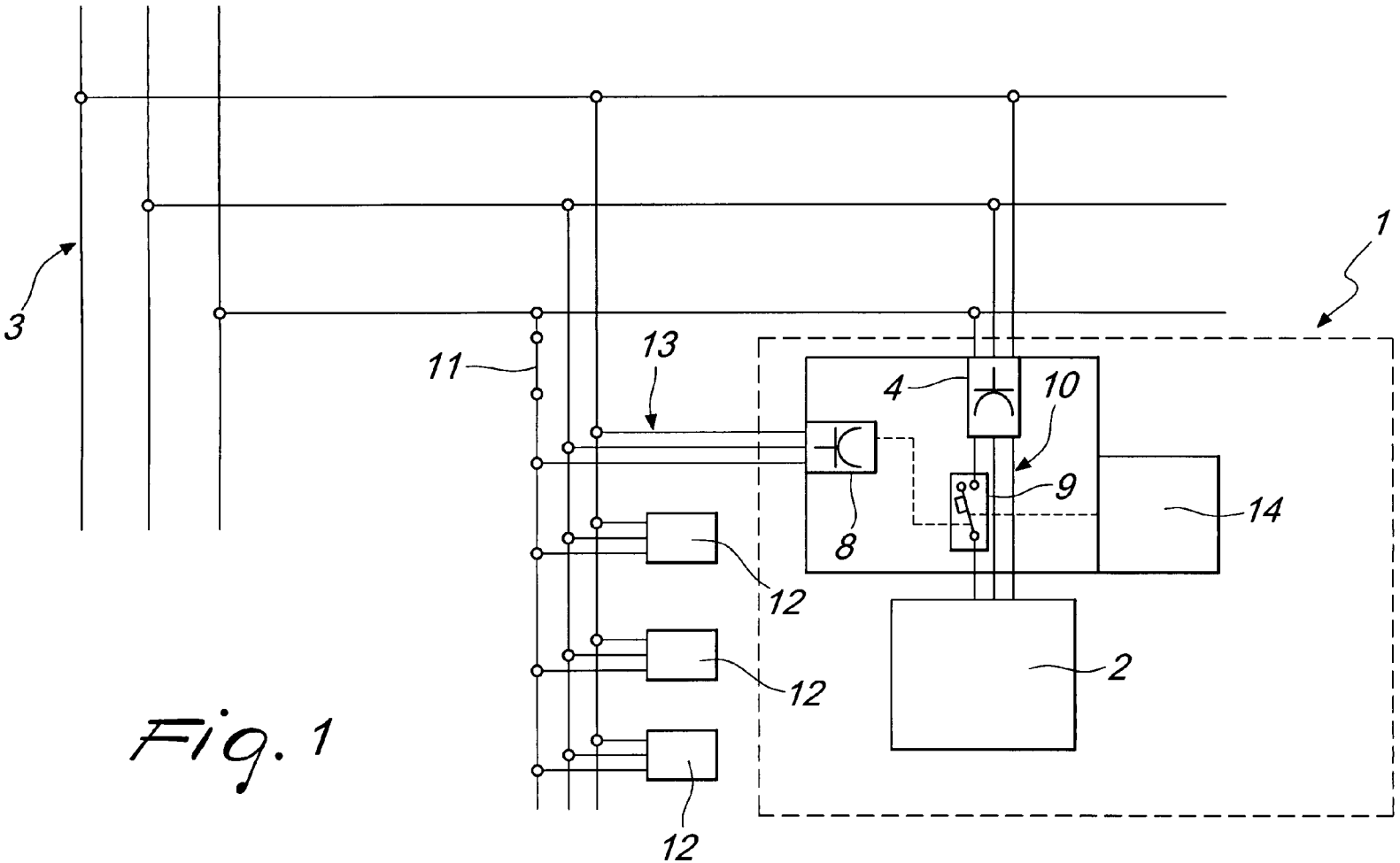
FIGS. 1 and 2 are an electrical diagram of the refrigeration unit according to the invention according to two different operating configurations.

With reference to the figures, a refrigeration unit according to the invention, generally designated by the reference numeral 1, comprises a refrigeration assembly 2 which is electrically connected to a mains 3 for its electrical power supply by means of a power input 4.

It should be noted from the outset that the refrigeration unit 1 is preferably of the type of minibars 5, typically placed in hotel rooms to offer small meals or fresh beverages, kept at the desired predefined temperature, to the occupants of said rooms.

According to this constructive solution, the refrigeration assembly 2 comprises a compressor which, in the presence of an electrical power supply, can be activated to remove heat inside a compartment 6, which is formed inside the unit 1 (which, as mentioned, might be the minibar 5) and is adapted to accommodate products 7 to be kept at a predefined temperature.

The role of such compressor is the known role of compressing an intermediate fluid for performing the refrigeration cycle that is necessary for the desired removal of heat inside the compartment 6.

Therefore, reference will be made to this constructive solution in the continuation of the present description; in any case, the protective scope that it defines also includes refrigeration units 1 which are designed for different uses and/or for different types of room, as well as units 1 which have the refrigeration assemblies 2 in which heat removal is performed by way of different means.

For example, the refrigeration assembly 2 might have one or more thermoelectric modules, the thermoelectric pairs of which allow, when electric current is applied thereto, to obtain the desired removal of heat.

According to the invention, the refrigeration unit 1 comprises at least one signal input 8 and at least one control switch 9, which is arranged along a power line 10, which in turn corresponds to the power input 4. The data that arrive from the signal input 8 are adapted to drive the control switch 9, which controls the power line 10 in order to determine the presence or absence of electrical power supply for the refrigeration assembly 2 and for the compressor, which are arranged downstream of the control switch 9 and of the power line 10.

According to a first constructive solution, the data provided at the signal input 8 originate directly from a sensor for detecting the presence of at least one person in the immediate vicinity of the unit 1.

It is therefore the detection of the presence of the person, for example by using appropriately located photocells, that causes the sending of a driving signal which is adapted to open the control switch 9, thus causing the lack of electrical power supply of the refrigeration assembly 2 and of the compressor.

Likewise, detection of the absence of the person sends a driving signal which closes the control switch 9 and therefore restores the electrical power supply of the refrigeration assembly 2 and of the compressor.

According to a different constructive solution, the data provided at the signal input 8 originate from a mains switch 11, which is arranged substantially downward of the electrical power supply mains 3: it is therefore the closure of the mains switch 11 that sends a driving signal adapted to open the control switch 9; vice versa, the opening of the mains switch 11 sends a driving signal adapted to close the control switch 9.

The constructive solution described above is of particular interest if, for example, it is necessary to install the minibar 5 in a hotel room in which, proximate to the access door, there is one mains switch 11 which can be operated by the occupant of the room when he enters.

The mains switches 11 are widespread for adjusting and limiting the electrical power supply of electrical loads 12 for which operation is not required when there are no people in the room (consider for example the television set or the various lamps used to light the room).

In this manner, it is in fact the room occupant himself who has to act on the mains switch 11 to operate the electrical loads 12 arranged downward and, by means of this action, he disconnect the minibar 5 from the mains 3, thus avoiding the risk of being disturbed by the noise generated by the compressor comprised therein.

In the meantime, the other electrical devices, such as for example the conditioning or heating system, can instead continue to operate because they are powered directly by the mains 3.

Figure 2:
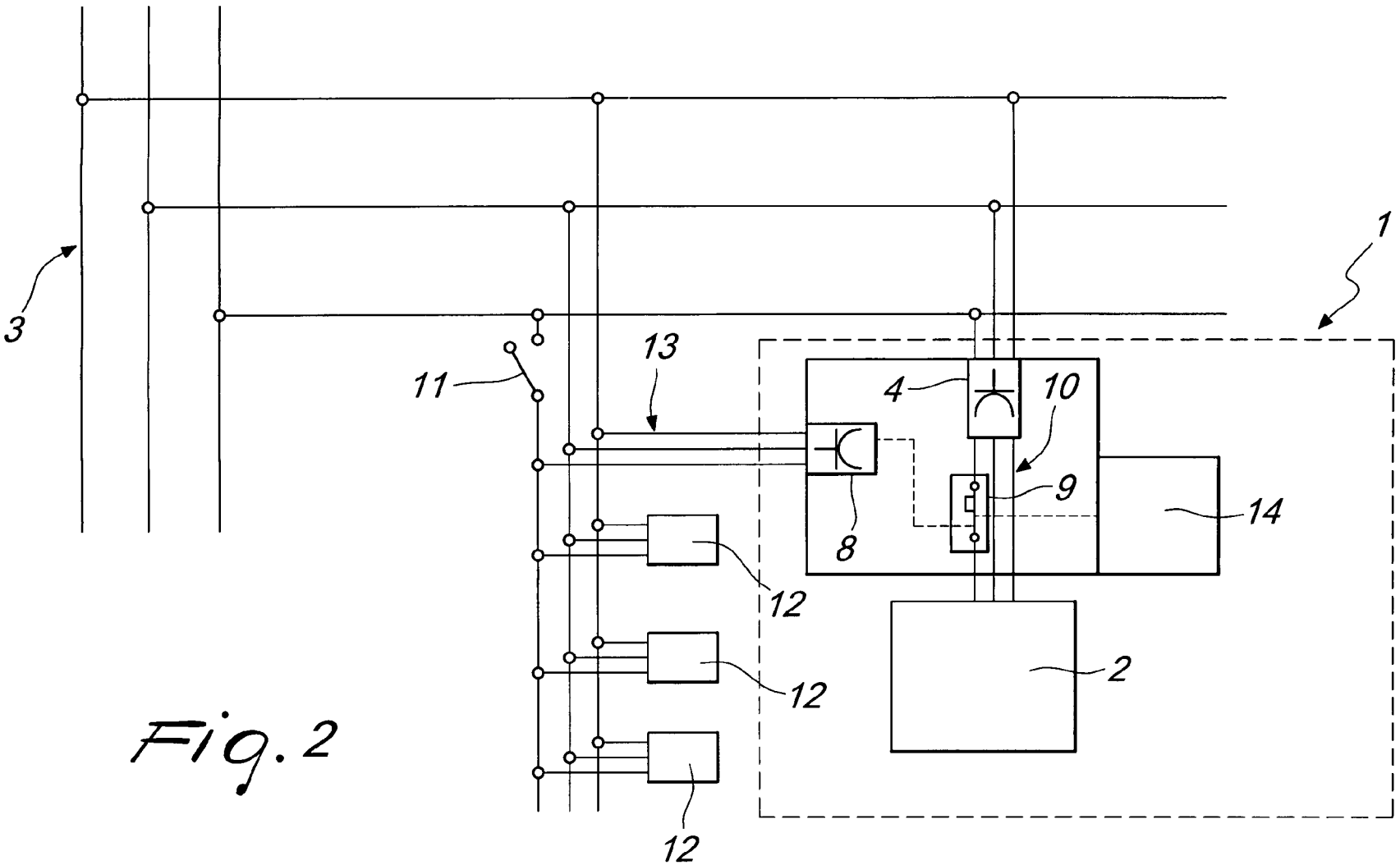
Figure 3:
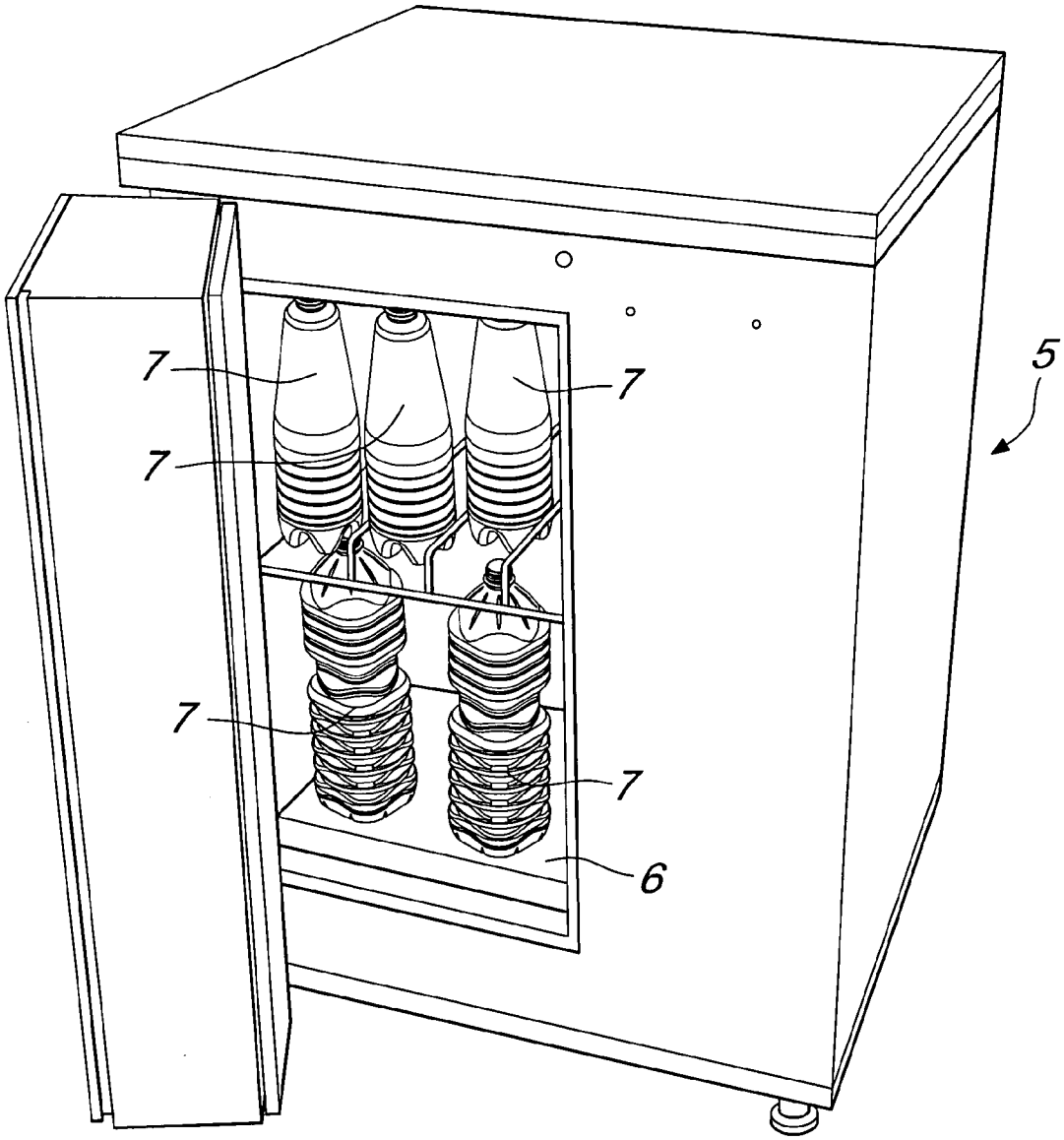
FIG. 3 is a perspective view of the refrigeration unit according to the invention according to a possible constructive embodiment.

According to a solution of particular practical interest, which is presented by way of non-limiting example in the accompanying FIGS. 1 and 2, the data provided at the signal input 8 are determined by a mains switch 11, which is driven by the detection sensor (therefore, the direct intervention of the person is not required): the driving signal (in a manner similar to the previous described solution) is constituted by the presence or absence of voltage across a signal line 13 which corresponds to the signal input 8.

The presence of voltage on the signal line 13 opens the control switch 9 and consequently interrupts the electrical power supply of the refrigeration assembly 2, thus bringing the refrigeration unit 1 to the configuration shown in FIG. 1.

The lack of voltage on the signal line 13 causes, vice versa, the closure of the control switch 9 and therefore allows the supply of power to the refrigeration assembly 2; the unit 1 thus reaches the configuration shown in FIG. 2.

The constructive solution described allows, for example, the application of the minibar 5, and more generally of a unit 1 according to the invention, in all rooms, such as hotel rooms, in which there is a sensor such as an electronic reader, arranged inside such hotel room and meant to receive and accommodate the electronic key which is now widely used to allow access. These sensors in turn are capable of driving a mains switch 11 for the purposes described above without requiring direct intervention of the person when he enters the room or when he exits from it.

Advantageously, the refrigeration unit 1 according to the invention comprises a safety device 14, which is capable of causing the forced restoration of the electrical power supply of the refrigeration assembly 2. The device 14 produces restoration if the value of the temperature inside the compartment 6 reaches a value which is higher than the predefined temperature by at least one preset increment.

More particularly, the safety device 14 comprises a thermostat, which is functionally associated with the control switch 9 in order to force its closure automatically, with consequent supply of electric power to the compressor, when the temperature inside the compartment 6 reaches, as mentioned above, a value higher than the predefined temperature by at least the preset increment.

Conveniently, the refrigeration unit 1 comprises a heat accumulator, which can be arranged inside the compartment 6 and contains a substance with a high heat accumulation power, in order to transfer heat during the operation of the compressor and vice versa absorb it when the compressor is switched off.

The operation of the refrigeration unit according to the invention is as follows.

If there are no people inside the room in which the refrigeration unit 1 is located, such unit is supplied with electric power, as in the example shown in FIG. 2.

In this configuration, the control switch 9 is in fact closed and the compressor can thus work to cool the compartment 6, for example according to preset timing cycles or operated by the above cited thermostat.

The operation of the compressor, and the noise associated therewith, do not cause discomfort, since there are no people in the room in which the refrigeration unit 1 is located.

If a person accesses the room, this causes the supply of power to the electric loads 12, by closing the mains switch 11, which is operated directly by the person or driven by the detection sensor. In turn, the closure of the mains switch 11 opens the control switch 9, thus disconnecting the compressor from the mains 3 and in practice deactivating the refrigeration unit 1, bringing it to the configuration of FIG. 1.

Of course, if the unit 1 is of the type described in the first constructive solution, the detection sensor itself is adapted to send a command signal to open the control switch 9.

Restoring the electrical power supply of the compressor is allowed by the opening of the mains switch 11, which occurs when the person leaves the room, as detected by the sensor or as a consequence of the action of such person on the mains switch 11.

Further, the presence of the safety device 14 offers protection against the damage that prolonged lack of electrical power supply might cause.

If, for example, the compressor should remain deactivated for too long, following the persistence of the permanence of one or more people in the room, with a consequent excessive rise of the temperature in compartment 6, the safety device 14 produces the forced restoration of the forced power supply, thus allowing reactivation of the compressor.

Further, the presence of the heat accumulator allows to delay the moment of the (forced or not forced) activation of the compressor; such accumulator is in fact capable of releasing heat during the operation of the compressor itself, to remove in turn heat from the products 7 introduced in the compartment 6 once the refrigeration assembly 2 has been deactivated.

Finally, with reference to the constructive solution that resorts to thermoelectric modules, as mentioned earlier, the entry of a person in the room might cause for example, in manners which are similar to the ones described above, the interruption of the electrical power supply of the fan of the condenser, thus eliminating the noise generated thereby.

In practice it has been found that the refrigeration unit according to the invention fully achieves the intended aim, since the presence of the control switch allows to determine the presence or absence of electrical power supply for the refrigeration assembly, upon data sent by means of a signal input, to thus allow to disconnect electrically the refrigeration assembly and avoid generating noise and thus causing discomfort to the people who are present nearby.

The invention thus conceived is susceptible of numerous modifications and variations, all of which are within the scope of the appended claims; all the details may further be replaced with other technically equivalent elements.

In the exemplary embodiments that follow, individual characteristics, given in relation to specific examples, may actually be interchanged with other different characteristics that exist in other exemplary embodiments.

Moreover, it is noted that anything found to be already known during the patenting process is understood not to be claimed and to be the subject of a disclaimer.

In practice, the materials used, as well as the dimensions, may be any according to requirements and to the state of the art.

The disclosures in European Patent Application No. 08425310.3 from which this application claims priority are incorporated herein by reference.

What is claimed is:

1. A refrigeration unit having a control and management assembly, comprising:

a refrigeration assembly;

at least one power input comprising a power line for supplying electrical power to said refrigeration assembly;

at least one compressor of said refrigeration assembly whereby a presence of electrical power supply allowing an activation of said compressor to remove heat in a compartment which is formed inside said refrigeration unit and which is adapted to accommodate products to be kept at a predefined temperature;

at least one control switch arranged on said power line for controlling power supply to said refrigeration assembly;

at least one signal input for sending data to said control switch for driving said control switch for determining supply of electrical power to said refrigeration assembly;

a sensor for detecting a presence of at least one person near said refrigeration unit and for supplying said data to said signal input whereby a detection of the presence of the at least one person causes a sending of a driving signal which is adapted to open said control switch and cause lack of power supply to said refrigeration assembly, and a detection of an absence of the at least one person causes a sending of a driving signal which is adapted to close said control switch and provide power supply to said refrigeration assembly; and a heat accumulator which is arranged inside said compartment and which contains a heat accumulation substance for releasing heat during operation of said compressor and for absorbing heat when said compressor is switched off.

2. The refrigeration unit according to claim 1, said compressor being arranged downstream of said power line and of said control switch.

3. The refrigeration unit according to claim 2, further comprising a safety device for forced restoration of electrical power supply to said refrigeration assembly when a temperature reached inside said compartment is higher than the predefined temperature by at least one preset increment.

4. The refrigeration unit according to claim 3, characterized in that said safety device comprises a thermostat which is functionally connected with said control switch for automatic closure of said control switch, with consequent supply of electric power to said at least one compressor when the temperature reached inside said compartment is higher than the predefined temperature by a preset increment.

5. A refrigeration unit having a control and management assembly, comprising:

a refrigeration assembly;

at least one power input comprising a power line for supplying electrical power to said refrigeration assembly;

at least one compressor of said refrigeration assembly a presence of electrical power suppler allowing an activation of said compressor to remove heat in a compartment which is formed inside said refrigeration unit and which is adapted to accommodate products to be kept at a predefined temperature;

at least one control switch arranged on said power line for controlling power supply to said refrigeration assembly;

at least one signal input for sending data to said control switch for driving said control switch for determining supply of electrical power to said refrigeration assembly;

a mains switch arranged substantially downstream of an electrical power supply mains for supplying said data to said signal input whereby a closure of said mains switch sending a driving signal which is adapted to open said control switch and cause lack of power supply to said refrigeration assembly, and an opening of said mains switch sending a driving signal which is adapted to close said control switch and provide power supply to said refrigeration assembly; and a heat accumulator which is arranged inside said compartment and which contains a heat accumulation substance for releasing meat during operation of, said compressor and for absorbing heat when said compressor is switched off.

6. The refrigeration unit according to claim 5, said compressor being arranged downstream of said power line and of said control switch.

7. The refrigeration unit according to claim 6, further comprising a safety device for forced restoration of electrical power supply to said refrigeration assembly when a temperature reached inside said compartment is higher than the predefined temperature by at least one preset increment.

8. The refrigeration unit according to claim 7, characterized in that said safety device comprises a thermostat which is functionally connected with said control switch for automatic closure of said control switch, with consequent supply of electric power to said at least one compressor when the temperature reached inside said compartment is higher than the predefined temperature by a preset increment.

9. A refrigeration unit having a control and management assembly, comprising:

a refrigeration assembly;

at least one power input comprising a power line for supplying electrical power to said refrigeration assembly;

at least one control switch arranged on said power line for controlling power supply to said refrigeration assembly;

at least one signal input for sending data to said control switch for driving said control switch for determining supply of electrical power to said refrigeration assembly; and a mains switch driven by a detection sensor for supplying said data to said signal input as a driving signal constituted by a presence or absence of voltage across a signal line, whereby the presence of voltage on the signal line causing an opening of said control switch and causing lack of power supply to said refrigeration assembly, and a lack of voltage causing a closure of said control switch and providing power supply to said refrigeration assembly.

10. The refrigeration unit according to claim 9, further comprising at least one compressor of said refrigeration assembly, said compressor being arranged downstream of said power line and of said control switch, whereby a presence of electrical power supply allowing an activation of said compressor to remove heat in a compartment which is formed inside said refrigeration unit and which is adapted to accommodate products to be kept at a predefined temperature.

11. The refrigeration unit according to claim 10, further comprising a safety device for forced restoration of electrical power supply to said refrigeration assembly when a temperature reached inside said compartment is higher than the predefined temperature by at least one preset increment.

12. The refrigeration unit according to claim 11, characterized in that said safety device comprises a thermostat which is functionally connected with said control switch for automatic closure of said control switch, with consequent supply of electric power to said at least one compressor when the temperature reached inside said compartment is higher than the predefined temperature by a preset increment.

13. The refrigeration unit according to claim 12, further comprising a heat accumulator which is arranged inside said compartment and which contains a heat accumulation substance for releasing heat during operation of said compressor and for absorbing heat when said compressor is switched off.

* * * * *